US005725268A

United States Patent [19]

Besasie et al.

[11] Patent Number: 5,725,268

[45] Date of Patent: Mar. 10, 1998

[54] PET WASTE RETRIEVAL AND DISPOSAL DEVICE

[76] Inventors: Joseph C. Besasie, 2107 E. Wood Pl., Shorewood, Wis. 53211; Robert P. Ryan, 940 Glenview Ave., Wauwatosa, Wis. 53213

[21] Appl. No.: 732,919

[22] Filed: Oct. 17, 1996

[51] Int. Cl.[6] ..... A01K 29/00; E01H 1/12

[52] U.S. Cl. ..... 294/1.3

[58] Field of Search ..... 294/1.3–1.5, 25, 294/55; 15/104.8, 227, 257.1, 257.6, 257.9; 2/20, 164

[56] References Cited

U.S. PATENT DOCUMENTS

| | | | |
|---|---|---|---|
| 3,857,597 | 12/1974 | Young | 294/1.3 |
| 4,003,595 | 1/1977 | Fano . | |
| 4,138,153 | 2/1979 | Brown . | |
| 4,230,354 | 10/1980 | Claras . | |
| 4,252,356 | 2/1981 | Tokuzumi . | |
| 4,272,116 | 6/1981 | Tufte, Jr. . | |
| 4,383,710 | 5/1983 | Fehr . | |
| 4,974,893 | 12/1990 | Grahn . | |
| 5,149,159 | 9/1992 | Bardes | 294/1.3 |
| 5,222,777 | 6/1993 | Clonch | 294/1.3 |
| 5,335,952 | 8/1994 | Clapper . | |
| 5,350,208 | 9/1994 | Heinrichson . | |

FOREIGN PATENT DOCUMENTS

| | | | |
|---|---|---|---|
| 3912-972 | 11/1989 | Germany | 294/1.3 |
| 2245818 | 1/1992 | United Kingdom | 294/1.3 |
| 2250677 | 6/1992 | United Kingdom | 294/1.3 |
| 89/05886 | 6/1989 | WIPO | 294/1.3 |

*Primary Examiner*—Dean Kramer

*Attorney, Agent, or Firm*—Ryan, Maki, Mann & Hohenfeldt

[57] ABSTRACT

A device for retrieving and disposing of pet feces is provided which includes a bag formed of flexible sheet material having an open end and a closed end. A tray having a bottom panel is attached to the closed end of the bag. The panel has a central score line, which forms a hinge line and side walls hingedly connected to each side of the panel on opposite sides of the score line. The side walls are pivotable, from a transportation and storage position folded against the bottom panel, to a use position normal to the panel. Thus the tray can be manipulated manually from within the bag to retrieve pet feces, and the bag subsequently inverted thereover to enclose the tray and the feces therein.

7 Claims, 2 Drawing Sheets

Fig. 1
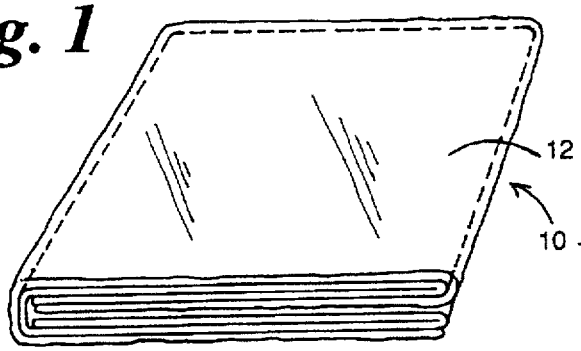
Fig. 4
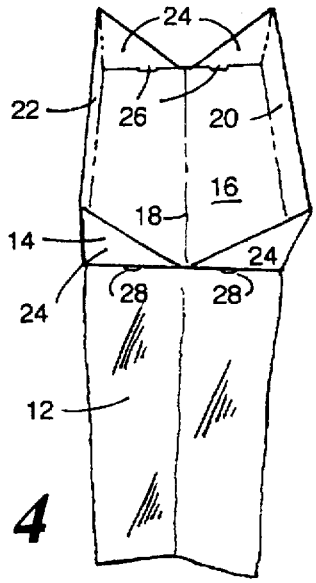
Fig. 2
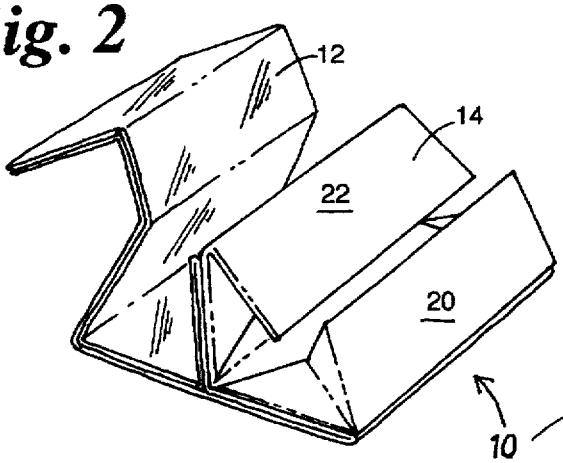
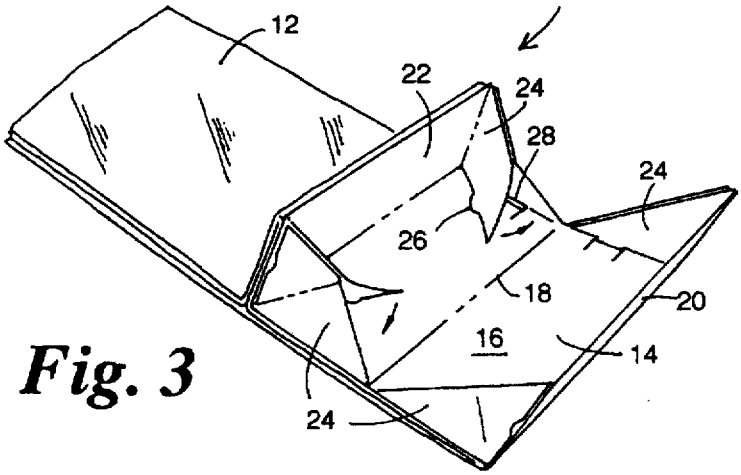
Fig. 3
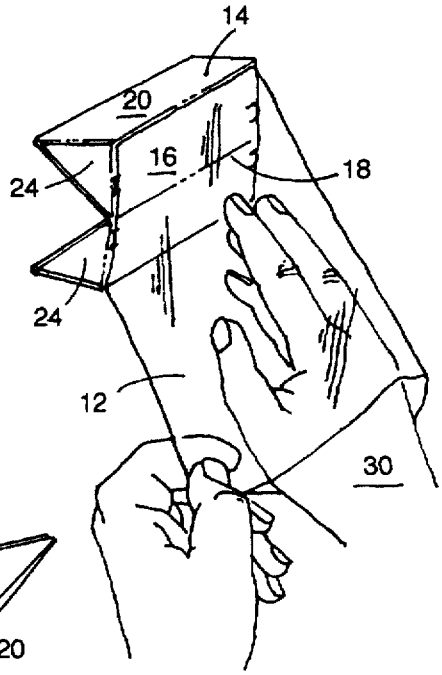
Fig. 5

Fig. 6
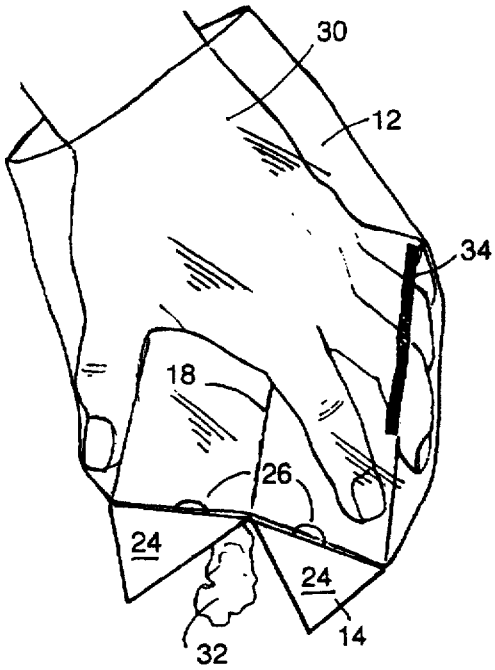
Fig. 7
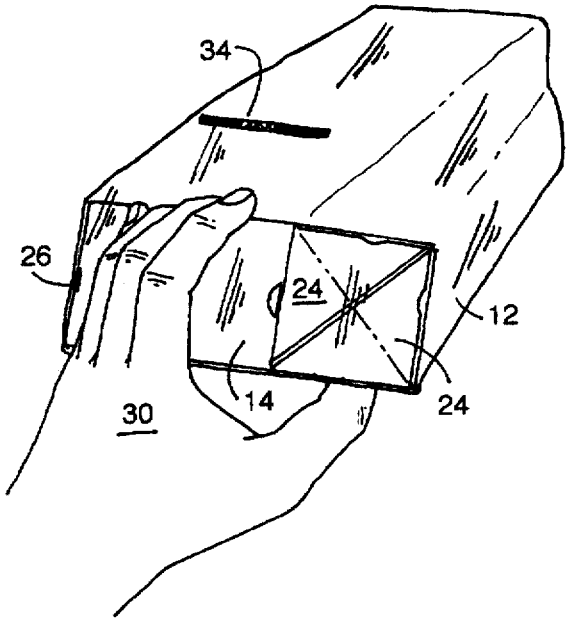
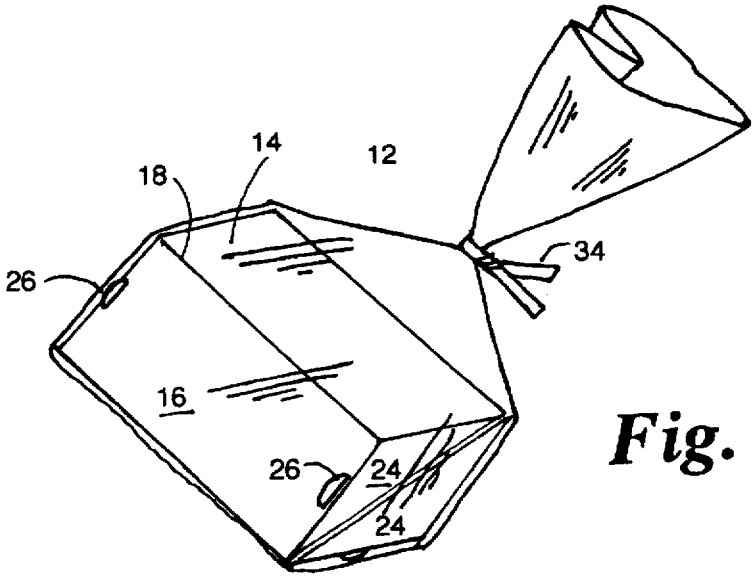
Fig. 8

PET WASTE RETRIEVAL AND DISPOSAL DEVICE

BACKGROUND OF THE INVENTION

This invention relates to retrieval and disposal devices for pet feces. More specifically, it relates to such a device which can readily be carried in a collapsed condition, easily set up and used, and which after use serves as a container for disposal of the waste.

Numerous devices have been developed for retrieval of animal feces, especially for domestic dogs. Many municipalities have by ordinance required that pet owners retrieve and dispose of the waste droppings of their pets. Thus, it is desirable for a dog owner to carry along a device for retrieving and disposing of the waste deposited by his dog when the dog is taken for a walk. For this purpose it has been common to use bags, for example, bags made out of plastic or paper. Also, devices formed in the shape of paperboard cartons with a scoop device for pushing the waste into a bag or cardboard container have been devised and suggested. Such devices, in use, require both hands. See, for example, U.S. Pat. Nos. 4,230,354, 4,252,356, 4,272,116 and 4,974,893. Other devices have supplied bags in conjunction with a means such as a handle for grasping the waste material. See, for example, U.S. Pat. Nos. 4,003,595, 4,383,710, 5,335,952 and 5,350,208. Many of these devices are cumbersome to carry when walking a pet and thus are not widely used. Others, such as a plain plastic bag, have a disadvantage that the waste must be grasped with the fingers, albeit located within the bag, a procedure which is highly distasteful for many individuals. A need has therefore continued to exist for an improved device which is convenient to carry while walking pets, which can be employed to grasp waste feces without direct touching by the fingers and which can be sealed to form a disposal container for the waste after it has been picked up.

SUMMARY OF THE INVENTION

The present invention has as its principal object the provision of a retrieval and disposal device for animal droppings which is compact and easy to carry, convenient and sanitary to use, and which after use provides a sanitary waste disposal device which can be conveniently deposited in a waste receptacle.

In accordance with an important aspect of the invention, the retrieval/disposal device of this invention can be folded into a flattened condition for sale and distribution and for carrying in a pocket or purse prior to use. In accordance with a further aspect of the invention, the device incorporates a feces grasping component which forms an integral part of the disposal container after use and which can be readily erected from the flat storage condition to the use configuration. In accordance with a further aspect, the invention combines such a retrieval container with an outer flexible container, preferably a plastic bag, which subsequent to use is inverted to form a disposal container.

In accordance with a still further aspect of the invention, a sealing device, preferably a wire tie can be attached to the flexible outer bag to serve to tightly close the container after use. In accordance with a further aspect, the outer bag may be transparent so that the retrieval and sealing procedure is visible to the user at all times.

Briefly, a device is provided for retrieving and disposing of pet feces which includes a bag formed of flexible sheet material having an open end and a closed end. A tray having a bottom panel is attached to the closed end of the bag. The panel has a central score line, which forms a hinge line and side walls hingedly connected to each side of the panel on opposite sides of the score line. The side walls are pivotable, from a transportation and storage position folded against the bottom panel, to a use position perpendicular to the bottom panel. Thus the tray can be manipulated manually from within the bag to retrieve pet feces, and the bag subsequently inverted thereover to enclose the tray and the feces contained therein.

BRIEF DESCRIPTION OF THE DRAWINGS

FIG. 1 is a perspective view of a retrieval/disposal device of this invention in its compact transportable condition;

FIG. 2 is a perspective view showing the device of FIG. 1 being unfolded;

FIG. 3 is a perspective view illustrating the erection of the paperboard portion of the device of FIG. 1;

FIG. 4 is a perspective view showing the device of FIG. 1 ready for use;

FIG. 5 is a perspective view showing the insertion of a user's hand into the device of FIG. 1;

FIG. 6 is a perspective view showing the use of the device in FIG. 1 to retrieve animal feces;

FIG. 7 is a perspective view showing inversion of the bag portion of the device of FIG. 1 around the paperboard container portion enclosing the animal feces; and FIG. 8 is a perspective view showing the device of FIG. 7 after it has been sealed with a wire tie.

DETAILED DESCRIPTION OF THE INVENTION

Referring more specifically to the drawings, there is seen in FIG. 1 a retrieval/disposal device 10 of this invention folded into a flattened orientation suitable for shipment to a sales or distribution point and subsequently for carrying by a user who is walking a pet, usually a dog. In the flattened condition device 10 can easily be carried in a purse or pocket.

As seen in the drawings, device 10 of this invention includes a bag 12 preferably of flexible plastic. Attached to the closed end of bag 12 is a paperboard container portion 14 to which bag 12 is secured by means of heat sealing or gluing.

As seen in the drawings, paperboard container portion 14 includes a bottom panel 16 which is provided with a lineal score 18 along its longitudinal central axis which serves as a hinge line for pivoting toward each other of the opposite sides of container 14. Opposed side wall panels 20 and 22 are joined to opposite sides of bottom panel 16 by score lines which are parallel to lineal score 18. Triangular corner portions 24 are provided at each end of both of the panels 20 and 22. Corner panels 24 may be locked in place by means of tabs 26 inserted through slots 28 at each end of bottom panel 16. The erection and insertion of the tabs 26 into slots 28 is best seen in FIGS. 2 and 3.

After the paperboard container portion 14 of the device has been erected, which can usually be accomplished in a matter of seconds, the user's hand 30 is inserted into bag 12 as seen in FIG. 5. Then, with the user's hand 30 in the bag, pet feces 32 can be scooped up using paperboard container 14 by flexing it along score line 18 as seen in FIG. 6.

After capture of feces 32 within container 14, the bag is inverted off of the user's hand 30 thus surrounding container 14 as shown in FIG. 7. A closure device such as wire tie 34 is preferably provided with bag 12 so that the container can be closed by means of wire tie 34 as shown in FIG. 8. After closure of the container in this manner, the container enclosing the feces within both bag 12 and inner container 14, can readily be disposed of in a waste receptacle. An optional means to provide for closure of bag 12 is provided by forming a hole through the bag sufficiently spaced from the end thereof to allow looping therethrough of the end thereof after the latter has been rolled up. Device 10, is thus completely closed, assuring an absence of odors and preventing waste materials from inadvertently falling out.

It will thus be appreciated that by using the device of this invention the feces 32 does not come in contact with the user's hand 30 nor need an annoying contact with the feces 32 be conducted in retrieving the same. The opposite end panels container 14 act to effectively form jaws, which both scrape the feces 32 off of a surface such as a lawn or sidewalk and effectively enclose feces 32 at the end of the retrieval operation.

Bag 12 is preferably formed from a plastic material. For this purpose a polyolefin polymer such a polyethylene or polypropylene is particularly suitable. Other flexible polymeric materials, or even paper may be substituted, if desired. The material of bag 12 may be opaque, is desired, but preferably a transparent bag which allows observation of the manipulation of tray 14 is used.

In accordance with a further optional feature, device 10 may be made entirely of biodegradable materials. Tray 14 is preferably formed of paperboard which, thus, forms a semi-rigid "clam shell" type configuration, which isolates the user from unpleasant tactile and visual sensations. It will be noted that bag 12, in effect, forms a mitten which provides complete protection of the user's hand from contact with animal waste during use. The device 10, accordingly provides obvious health benefits by preventing contact of the waste materials by humans or access by other animals or flies or other insects which could enable an unwanted transfer of disease-causing organisms.

Because of is portability in the compact, folded state, several devices of this invention can be carried in an average purse or pocket, or, if desired, attach to a leash. Thus the user's hands remain entirely free for control of the animal. Devices 10 can be marketed in several sizes to provide added convenience to pet owners having pets of various sizes.

While preferred embodiments of the invention have been shown for purposes of illustration, it will be apparent to those skilled in the art that various modifications can be made falling within the spirit of the invention and the true scope of the appended claims.

We claim:

1. A device for retrieving and disposing of pet feces comprising a bag formed of flexible sheet material having an open end and a closed end, a tray having a bottom panel having an interior surface and an exterior surface, attached to said closed end of said bag, said panel having a central score line defining two panel halves which are pivotable relative to each other along said score line, the exterior surface of each of said panel halves being adhered to said closed end of said bag, an end panel hingedly connected to the edge of each of said panel halves opposite said score line, and side walls hingedly connected to each end of both halves of said panel said end panels and said side walls being pivotable from a position folded against the interior of said bottom panel to a use position perpendicular to said panel, whereby said tray can be manipulated manually from within said bag to retrieve pet feces, and said bag subsequently inverted thereover to enclose said tray and said feces.

2. A device according to claim 1 wherein a triangular upstanding end wall is provided at each corner of said bottom panel, each said end wall being hingedly connected at its adjoining edges to said bottom panel and to one of said side walls.

3. A device according to claim 1 wherein said bag comprises a polyolefin polymer.

4. A device according to claim 1 wherein said tray is formed of paperboard.

5. A device according to claim 1 wherein said tray is attached to said bag by means of an adhesive.

6. A device according to claim 1 wherein a wire tie is provided for closure of said bag after retrieval of animal feces.

7. A device according to claim 1 wherein said tray is provided with equally dimensioned sides on opposite sides of said score line which pivot toward each other along said score line in "clam shell" fashion.

* * * * *